US009512736B2

(12) United States Patent
Gendrich

(10) Patent No.: US 9,512,736 B2
(45) Date of Patent: Dec. 6, 2016

(54) MONITORING ONE OR MORE TURBINE ENGINE ROTOR BLADES BY CORRELATING MEASUREMENT DATA AND REFERENCE DATA AS A FUNCTION OF TIME

(75) Inventor: Charles P. Gendrich, Middletown, CT (US)

(73) Assignee: United Technologies Corporation, Farmington, CT (US)

( * ) Notice: Subject to any disclaimer, the term of this patent is extended or adjusted under 35 U.S.C. 154(b) by 979 days.

(21) Appl. No.: 13/470,982

(22) Filed: May 14, 2012

(65) Prior Publication Data

US 2013/0304418 A1 Nov. 14, 2013

(51) Int. Cl.
*F01D 17/02* (2006.01)
*F01D 17/20* (2006.01)

(52) U.S. Cl.
CPC ..... *F01D 17/02* (2013.01); *F01D 17/20* (2013.01); *F05D 2270/334* (2013.01); *F05D 2270/804* (2013.01); *F05D 2270/821* (2013.01)

(58) Field of Classification Search
CPC ..... F01D 17/02
USPC ..... 702/182
See application file for complete search history.

(56) References Cited

U.S. PATENT DOCUMENTS 4,080,823 A 3/1978 Stargardter
5,148,711 A 9/1992 Twerdochlib et al.
5,471,880 A * 12/1995 Lang et al. ..... 73/660
5,498,137 A 3/1996 El-Aini et al.
6,195,982 B1 3/2001 Gysling et al.
6,785,635 B2 8/2004 von Flotow
7,941,281 B2 5/2011 Rai et al.
7,984,656 B2 7/2011 Nicklous et al.
2009/0177363 A1 7/2009 Kulczyk et al.
2010/0153031 A1* 6/2010 Russhard ..... 702/56
2011/0098948 A1 4/2011 Platt et al.
2011/0231171 A1 9/2011 Jousselin
2011/0293403 A1 12/2011 Badami

OTHER PUBLICATIONS

Gendrich et al. A Spatial Correlation Technique for Estimating Velocity Fields Using Molecular Tagging Velocimetry (MTV), Experiments in Fluids, vol. 22, 1996, pp. 67-77.

* cited by examiner

*Primary Examiner* — Aditya Bhat
(74) *Attorney, Agent, or Firm* — O'Shea Getz P.C.

(57) ABSTRACT

A method is provided for monitoring one or more rotating turbine engine rotor blades using a processing system and a sensor having a measurement field. The method includes steps of: (i) providing measurement data from the sensor as a first of the rotor blades passes through the measurement field; (ii) correlating the measurement data with reference data as a function of time to provide correlation data; and (iii) processing the correlation data to determine a peak correlation value that corresponds to a point in time during the passage of the first of the rotor blades through the measurement field; wherein the correlating and the processing are performed by the processing system.

20 Claims, 8 Drawing Sheets

MONITORING ONE OR MORE TURBINE ENGINE ROTOR BLADES BY CORRELATING MEASUREMENT DATA AND REFERENCE DATA AS A FUNCTION OF TIME

BACKGROUND OF THE INVENTION

1. Technical Field

This disclosure relates generally to a method for monitoring one or more turbine engine rotor blades as a function of time.

2. Background Information

A typical non-interference stress measurement system (NSMS) monitors one or more turbine engine rotor blades to determine various rotor blade properties such as actual rotor blade time of arrival, rotor blade deflection, etc. The NSMS may estimate, for example, that a first blade arrives at a particular measurement location when a voltage signal provided by a corresponding blade position sensor rises above a triggering threshold. A difference between the estimated time of arrival and a predicted time of arrival may be multiplied by a known rotational velocity of the first blade to determine the first blade deflection. The predicted time of arrival corresponds to a point in time when the first blade should arrive at the measurement location absent any blade deflection. Various additional rotor blade properties such as rotor blade stress may be calculated based on the estimated time of arrival and/or the blade deflection.

Noise in the voltage signal provided by the blade position sensor may introduce error into the estimated time of arrival and, thus, the blade deflection measurement. The noise, for example, may cause a premature or delayed rise of the signal above the triggering threshold. Such noise therefore can disadvantageously reduce NSMS accuracy and precision.

SUMMARY OF THE DISCLOSURE

According to an aspect of the invention, a method is provided for monitoring one or more rotating turbine engine rotor blades using a processing system and a sensor having a measurement field. The method includes steps of: (i) providing measurement data from the sensor as a first of the rotor blades passes through the measurement field; (ii) correlating the measurement data with reference data as a function of time to provide correlation data; and (iii) processing the correlation data to determine a peak correlation value that corresponds to a point in time during the passage of the first of the rotor blades through the measurement field; wherein the correlating and the processing are performed by the processing system.

In an embodiment, the correlation data includes a plurality of correlation coefficients. Each of the correlation coefficients corresponds to a different point in time during the passage of the first of the rotor blades through the measurement field. In one embodiment, the peak correlation value comprises a first of the correlation coefficients having a value that is greater than values of the other correlation coefficients. In another embodiment, the processing includes steps of fitting a mathematical function (e.g., polynomial or Gaussian function) to the correlation coefficients, and processing the mathematical function to determine a peak correlation coefficient, which comprises the peak correlation value.

In an embodiment, the correlating is performed using the following equation or an equivalent or derivation thereof:

$$R_t = \frac{\overline{xy}_t - \overline{x}_t \cdot \overline{y}_t}{\sigma_{x_t} \cdot \sigma_{y_t}},$$

wherein R is a correlation coefficient, $\overline{x}$ is a time averaged matrix of a plurality of reference values included in the reference data, $\overline{y}$ is a time averaged matrix of a plurality of measurement values included in the measurement data, $\sigma_x$ is a standard deviation of x, $\sigma_y$ is a standard deviation of y, and t is a point in time during the passage of the first of the rotor blades through the measurement field.

In an embodiment, the correlation data includes a plurality of cross correlation values. Each of the cross correlation values corresponds to a different point in time during the passage of the first of the rotor blades through the measurement field.

In an embodiment, the correlating is performed using the following equation or an equivalent or derivation thereof:

$$\overline{xy}_t = \frac{1}{N}\sum_{i=1}^{N}(x_i \cdot y_i),$$

wherein $\overline{xy}$ is a cross correlation value, x is a matrix of a plurality of reference values included in the reference data, y is a matrix of a plurality of measurement values included in the measurement data, t is a point in time during the passage of the first of the rotor blades through the measurement field, and N is a total number of points in time up to t during the passage of the first of the rotor blades through the measurement field.

In an embodiment, the method also includes a step of determining a time of arrival of the first of the rotor blades at a reference location based on the peak correlation value.

In an embodiment, the method also includes a step of providing a once per revolution signal based on the time of arrival.

In an embodiment, the method also includes a step of determining the identity of the first of the rotor blades based on the peak correlation value, wherein each of the rotor blades has a different identity.

In an embodiment, the method also includes steps of: comparing the peak correlation value to a threshold; and performing the following steps where the peak correlation value is less than the threshold: (a) correlating the measurement data with second reference data as a function of time to provide second correlation data, where the reference data corresponds to the first of the rotor blades, and the second reference data corresponds to an adjacent one of the rotor blades; (b) processing the second correlation data to determine a second peak correlation value that corresponds to a second point in time during the passage of the first of the rotor blades through the measurement field; and (c) comparing the second peak correlation value to the threshold. In one embodiment, the method also includes a step of determining a time of arrival of the first of the rotor blades at a reference location based on the second peak correlation value where the second peak correlation value is greater than the threshold. In another embodiment, the method also includes a step of determining the identity of the first of the rotor blades based on the second peak correlation value where the second peak correlation value is greater than the threshold, wherein each of the rotor blades has a different identity. In still another embodiment, the method also includes a step of determining presence of at least one of a once per revolution signal dropout and rotor blade jitter based on the identity of the first of the rotor blades.

In an embodiment, the method also includes steps of: (a) correlating second measurement data for a second of the rotor blades with second reference data as a function of time to provide second correlation data; (b) processing the second correlation data to determine a second peak correlation value that corresponds to a second point in time during passage of the second of the rotor blades through the measurement field of the sensor or a second measurement field of a second sensor; and (c) determining a property of one or more of the rotor blades based on the peak correlation value and the second peak correlation value, wherein the property is a modal response magnitude and/or a nodal diameter.

In an embodiment, the method also includes steps of: (a) performing the correlating and the processing for a plurality of rotations of the first of the rotor blades around an axis to provide the peak correlation value for each of the rotations; and (b) determining a property of the first of the rotor blades based on the peak correlation values. In one embodiment, the property is a time of arrival of the first of the rotor blades at a reference location. In another embodiment, the property is a chordwise deflection of the first of the rotor blades. In still another embodiment, the property is a modal response magnitude and/or a nodal diameter.

In an embodiment, the method also includes steps of: (a) providing second measurement data from a second sensor as the first of the rotor blades passes through a second measurement field of the second sensor; (b) correlating the second measurement data with the reference data as a function of time to provide second correlation data; (c) processing the second correlation data to determine a second peak correlation value that corresponds to a point in time during the passage of the first of the rotor blades through the second measurement field; and (d) determining a property of the first of the rotor blades based on the peak correlation value and the second peak correlation value.

The foregoing features and the operation of the invention will become more apparent in light of the following description and the accompanying drawings.

DETAILED DESCRIPTION OF THE INVENTION

Figure 1:
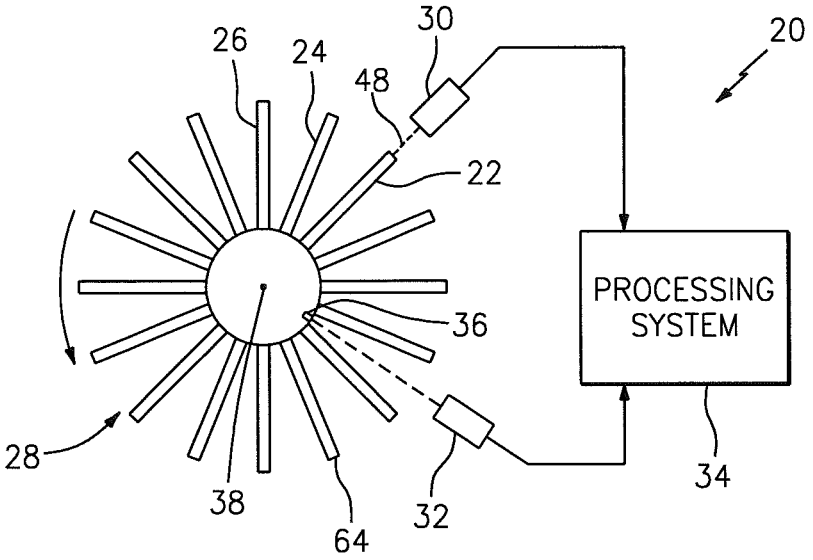
FIG. 1 is a block diagram illustration of a system for monitoring one or more rotor blades of a turbine engine rotor.

FIG. 1 is a block diagram illustration of a (e.g., non-interference measurement) system 20 for monitoring one or more rotor blades 22, 24, 26 of a turbine engine rotor 28. Examples of rotor blades may include fan blades, compressor blades, turbine blades, etc. The system 20 includes a blade position sensor 30, a rotor position sensor 32 and a processing system 34.

The blade position sensor 30 (also sometimes referred to as a "time of arrival sensor") is configured as a non-interference light sensor. Such a light sensor is operable to direct focused or unfocused light (e.g., white light, a laser, etc.) towards the rotor 28, and measure a quantity of the light reflected by the rotor 28 and the rotor blades 22, 24, 26 back towards the sensor 30. An example of a light sensor is disclosed in U.S. Pat. No. 7,984,656, which is hereby incorporated herein by reference in its entirety. The present invention, however, is not limited to any particular type of blade position sensor. In another embodiment, for example, the blade position sensor 30 can be configured as a non-interference radio sensor that is operable to direct radio (e.g., radar) waves towards the rotor, and measure frequency and/or phase modulation induced by the rotor blades during rotor rotation. In still another embodiment, the blade position sensor 30 can be configured as an eddy current, inductive and/or capacitive sensor, etc.

The rotor position sensor 32 (also sometime referred to as a "once per revolution sensor") is also configured as a non-interference light sensor. Such a light sensor is operable to direct focused or unfocused light (e.g., white light, a laser, etc.) towards the rotor 28, and measure the light reflected by a reference point 36 (e.g., a marker) on the rotor 28. The present invention, however, is not limited to any particular type of rotor position sensor.

The processing system 34 can be implemented using hardware, software, or a combination thereof. The hardware can include one or more processors, a memory, analog and/or digital circuitry, etc. The processing system 34 is in signal communication (e.g., hardwired or wirelessly connected) with the blade position sensor 30 and the rotor position sensor 32.

Figure 2:
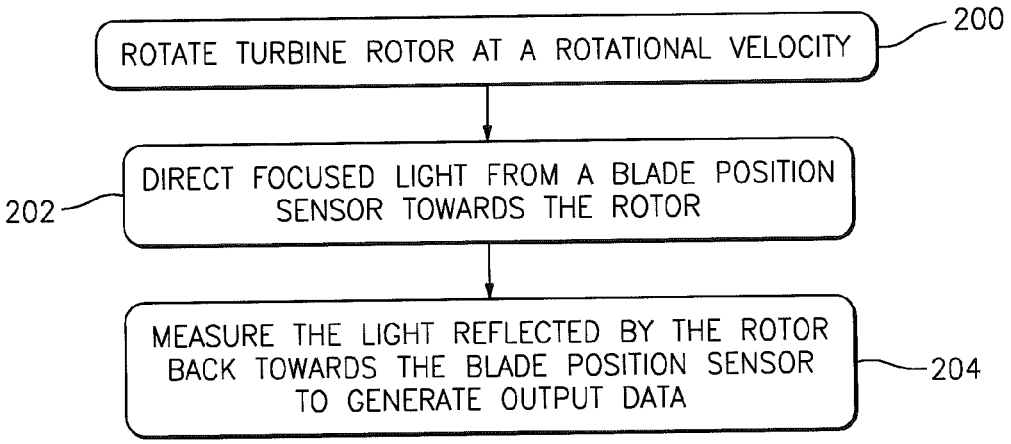
FIG. 2 is a flow diagram of a method for generating output data with a blade position sensor.

FIG. 2 is a flow diagram of a method for generating output data with the blade position sensor 30 illustrated in FIG. 1. In step 200, the rotor 28 is rotated about its rotational axis 38 at a (e.g., substantially constant) rotational velocity. During a method to generate reference data, for example, the rotor 28 can be rotated at a rotational velocity corresponding to turbine engine idle. During a method to monitor one or more of the rotor blades 22, 24, 26, the rotor 28 can be rotated at a rotational velocity corresponding to turbine engine idle, part throttle, full throttle, etc. The aforesaid methods for generating reference data and monitoring the rotor blades will be described below in further detail.

In step 202, the blade position sensor 30 directs light towards the rotor 28. In step 204, the blade position sensor 30 measures the quantity of light reflected by the rotor 28 and, in particular, the rotor blades 22, 24, 26 to generate the output data. The output data is indicative of a digital series (or analog stream) of blade position sensor 30 outputs (e.g., voltages) that correspond to the quantity of reflected light measured by the blade position sensor 30 as the rotor 28 rotates about the rotational axis 38. Each of the blade position sensor 30 outputs corresponds to a respective time (e.g., time step) during the rotation of the rotor 28.

Figure 3:
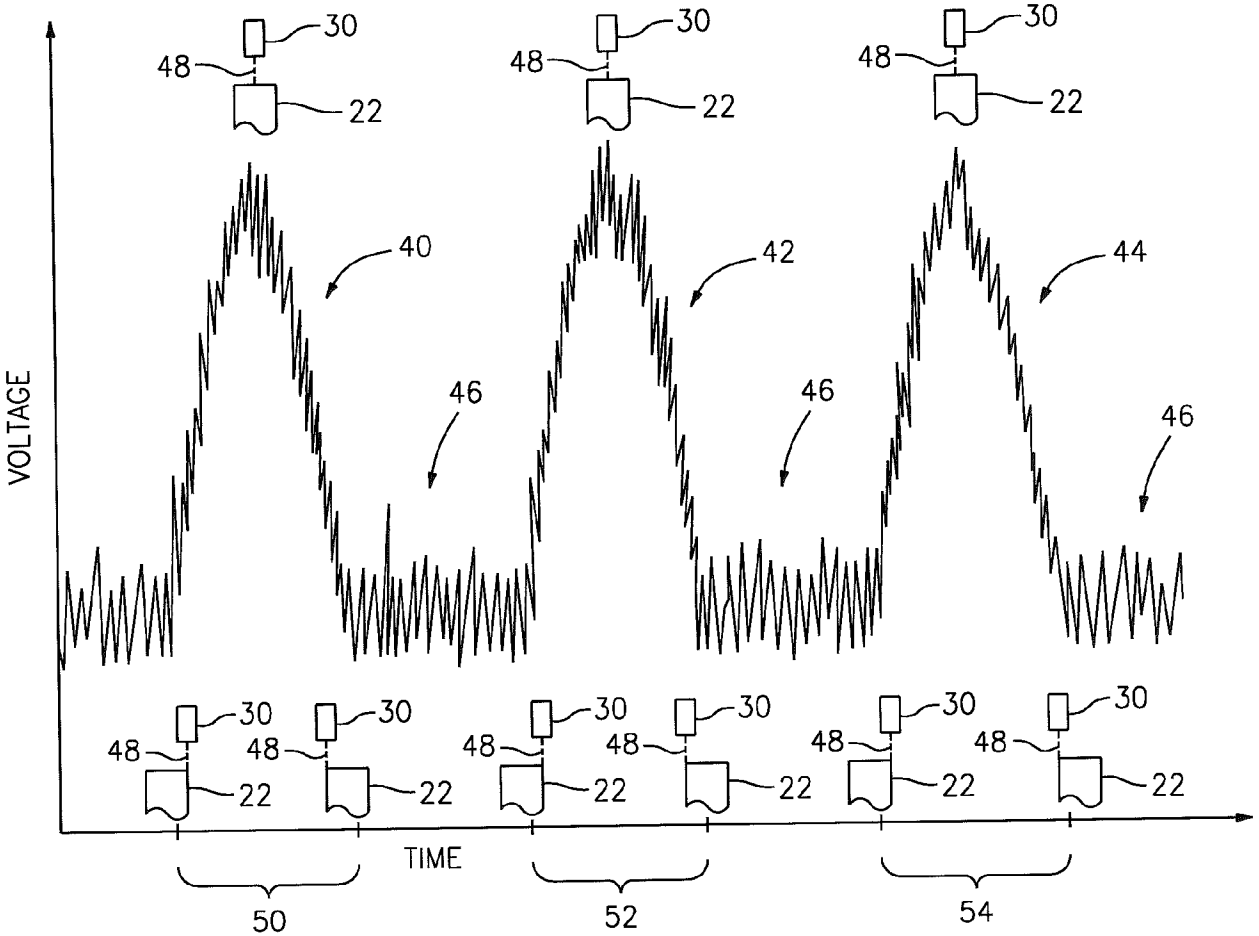
FIG. 3 is a graphical depiction of a portion of the output generated by the method of FIG. 2.

Referring to FIG. 3, the output data can include first blade measurement data 40, second blade measurement data 42, third blade measurement data 44, etc. as well as between blade measurement data 46. The first blade measurement data 40 includes the blade position sensor 30 outputs that correspond to a first of the rotor blades (hereinafter "first blade 22") passing through a measurement field 48 (e.g., an area of the light) of the blade position sensor 30; e.g., during a first blade time trace 50. The term "blade time trace" is used herein to describe a period of time that a respective rotor blade takes to pass through the measurement field 48 at a particular rotor rotational velocity. The second measurement data 42 includes the blade position sensor 30 outputs that correspond to a second one of the rotor blades (hereinafter "second blade 24") passing through the measurement field 48; e.g., during a second blade time trace 52. The third measurement data 44 includes the blade position sensor 30 outputs that correspond to a third one of the rotor blades (hereinafter "third blade 26") passing through the measurement field 48; e.g., during a third blade time trace 54. The between blade measurement data 46 includes the blade position sensor 30 outputs that correspond to the time between adjacent blades (e.g., blades 22 and 24) passing through the measurement field 48.

Figure 4:
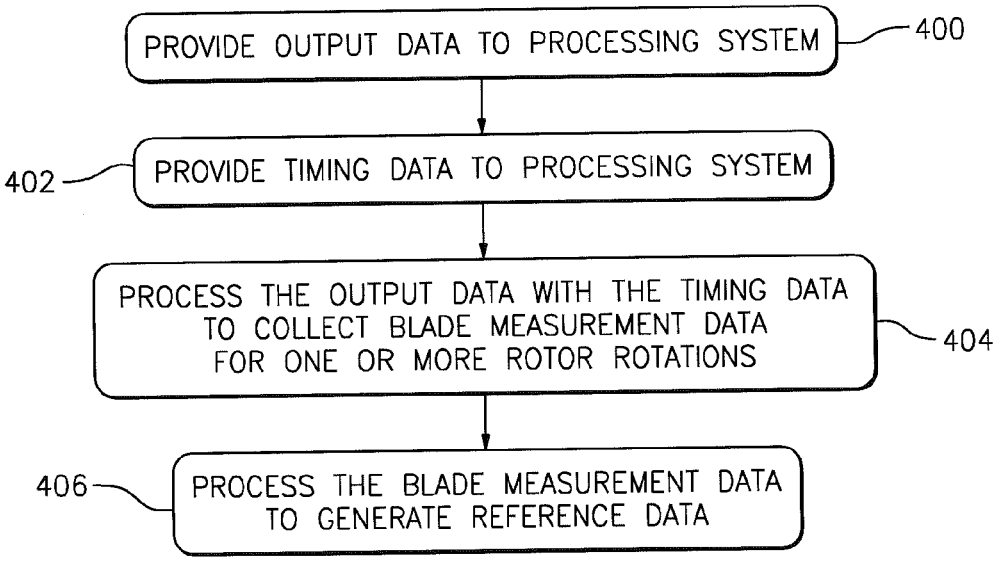
FIG. 4 is a flow diagram of a method for generating reference data for a rotor blade.

FIG. 4 is a flow diagram of a method for generating reference data for the first blade 22 utilizing the system illustrated in FIG. 1. In step 400, the blade position sensor 30 provides output data to the processing system 34. The output data can correspond to, as described above, a rotor 28 rotational velocity at turbine engine idle.

In step 402, the rotor position sensor 32 provides timing data to the processing system 34. The timing data is indicative of when the reference point 36 on the rotor 28 passes the rotor position sensor 32.

In step 404, the processing system 34 collects first blade measurement data for one or more rotor rotations about the rotational axis 38. The processing system 34, for example, may process the output data with the timing data, in a known fashion, to separate the first blade measurement data from the other output data for each of the rotor 28 rotations. The separated first blade measurement data may subsequently be stored in a memory.

Figure 5:
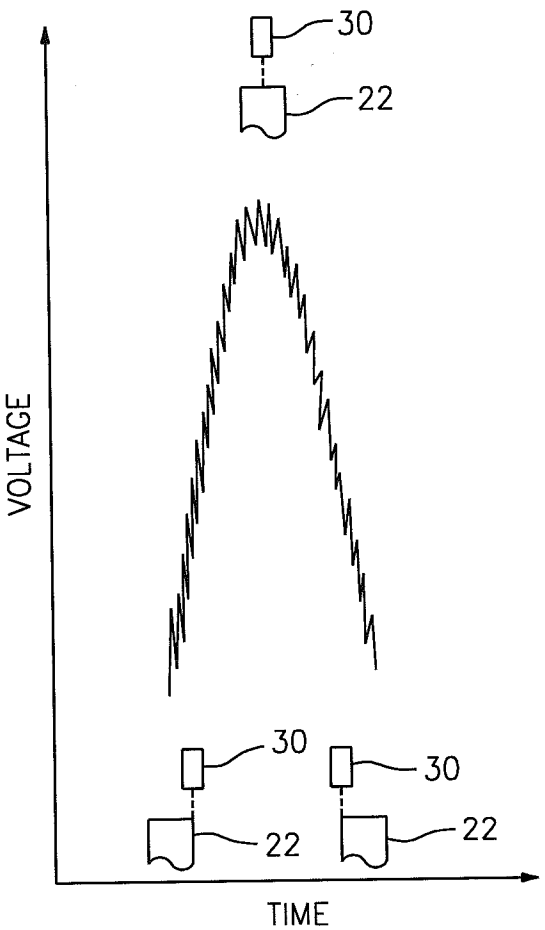
FIG. 5 is a graphical depiction of a portion of the reference data generated by the method of FIG. 4.

In step 406, the processing system 34 processes the stored first blade measurement data to generate the reference data. The processing system 34, for example, may filter and average the stored first blade measurement data over the number of the rotor 28 rotations to provide the reference data. Referring to FIG. 5, the reference data includes a series of averaged blade position sensor reference outputs (e.g., voltages). Each of the reference outputs corresponds to a respective time (e.g., time step) during a reference first blade time trace.

In some embodiments, the processing system 34 may also collect and process the blade measurement data corresponding to one or more of the other rotor blades; e.g., the second blade 24, the third blade 26, etc. In this manner, the processing system 34 may generate reference data that includes a series of averaged blade position sensor reference outputs for each of the respective rotor blades.

Figure 6:
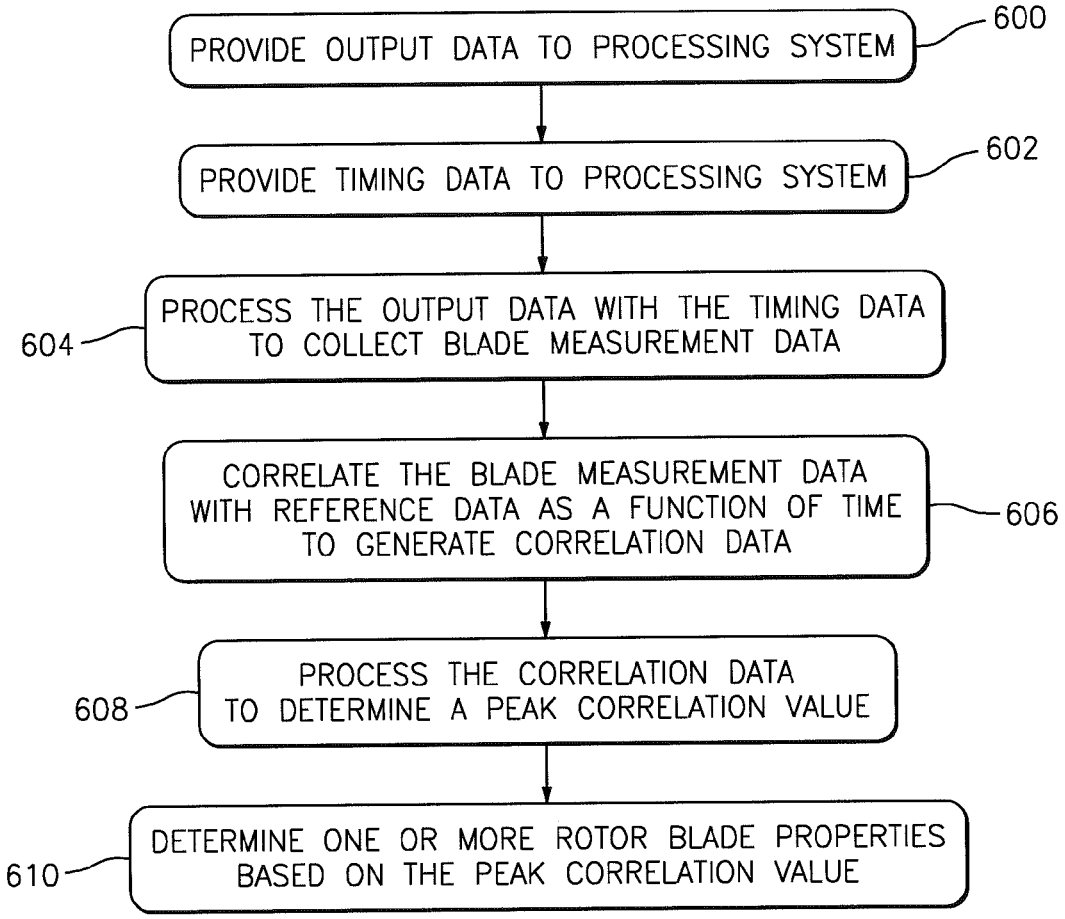
FIG. 6 is a flow diagram of a method for monitoring the rotor blade in FIG. 4.

FIG. 6 is a flow diagram of a method for monitoring the first blade 22 utilizing the system illustrated in FIG. 1. In step 600, the blade position sensor 30 provides output data to the processing system 34. The output data can correspond to, as described above, a rotor 28 rotational velocity at turbine engine idle, part throttle, full throttle, etc. In step 602, the rotor position sensor 32 provides timing data to the processing system 34.

In step 604, the processing system 34 collects the first blade measurement data for a rotor 28 rotation about the rotational axis 38. The processing system 34, for example, may process the output data with the timing data, in a known fashion, to separate the first blade measurement data from the other portions of the output data.

In step 606, the processing system 34 correlates the first blade measurement data with a portion of the reference data corresponding to the first blade 22 as a function of time to generate correlation data. The processing system 34, for example, can process the first blade measurement data and the reference data using a correlation equation. An example of a correlation equation is as follows:

$$R_t = \frac{\overline{xy}_t - \overline{x}_t \cdot \overline{y}_t}{\sigma_{x_t} \cdot \sigma_{y_t}} \quad \text{(eqn. 1)}$$

where R is a correlation coefficient, $\overline{x}$ is a time averaged matrix of a plurality of reference values included in the reference data, $\overline{y}$ is a time averaged matrix of a plurality of measurement values included in the measurement data, $\sigma_x$ is a standard deviation of x, $\sigma_y$ is a standard deviation of y, and t is a point in time (e.g., time step) during the first blade time trace; e.g., during the passage of the first blade 22 through the measurement field 48. The cross correlation of x and y (e.g., $\overline{xy}_t$) can be determined as follows:

$$\overline{xy}_t = \frac{1}{N}\sum_{i=1}^{N}(x_i \cdot y_i) \quad \text{(eqn. 2)}$$

where N is a total number of points in time (e.g., time steps) up to t during the first blade time trace; e.g., $0>N\geq t$. The standard deviation of x (e.g., $\sigma_{x_t}$) can be determined as follows:

$$\sigma_{x_t} = \sqrt{\frac{1}{N}\sum_{i=1}^{N}(x_i - \overline{x})^2}\ . \quad \text{(eqn. 3)}$$

The standard deviation of y (e.g., $\sigma_{y_t}$) can be determined as follows:

$$\sigma_{y_t} = \sqrt{\frac{1}{N}\sum_{i=1}^{N}(y_i - \overline{y})^2}\ . \quad \text{(eqn. 4)}$$

The aforesaid correlation equation (eqn. 1) may normalize a magnitude and root mean square (RMS) of the first measurement data. The correlation data generated with the correlation equation therefore may include significantly less noise than the original output data received from the blade position sensor 30. In addition, the correlation data can account for blade-to-blade differences in output data signal amplitude. Utilizing the correlation equation therefore can improve blade monitoring accuracy as compared to prior art methods as described in the background.

The correlation data generated with the correlation equation (eqn. 1) includes a plurality of correlation coefficients (e.g., $R_1, R_2, \ldots, R_N$). Each of the correlation coefficients corresponds to a respective point in time (e.g., time step) during the first blade time trace, and has a value (e.g., between 0 and 1).

A person of ordinary skill in the art will understand that the aforesaid correlation can be performed with various derivations or equivalents of the above equations as well as with other correlation equations and/or algorithms. In an alternate embodiment, for example, the correlation between the first blade measurement data and the reference data can be performed utilizing the cross correlation equation (eqn. 2) or a derivation or an equivalent thereof. The correlation data generated with the cross correlation equation includes a plurality of cross correlations (e.g., $\overline{xy}_1, \overline{xy}_2, \ldots, \overline{xy}_N$), where each of the cross correlations corresponds to a respective point in time (e.g., time step) during the first blade time trace.

In some embodiments, the processing system 34 may process the reference data and/or the first blade measurement data with a transfer function prior to performing the aforesaid correlation. Such a transfer function is utilized to account for differences in rotor 28 rotational velocities between when (i) the output data was received during step 400 and (ii) the output data was received during step 600. The transfer function, for example, may normalize the reference data to the rotor 28 rotational velocity at which the output data and, thus, the first blade measurement data in step 600 was obtained.

Figure 7:
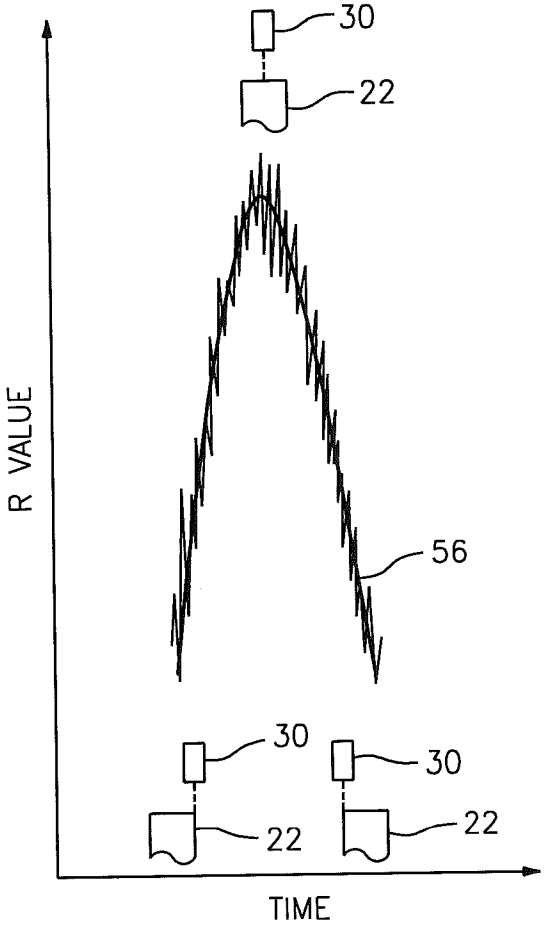
FIG. 7 is graphical depiction of a polynomial fitted to a plurality of correlation coefficients.

In step 608, the processing system 34 processes the correlation data to determine a peak (e.g., maximum) correlation value. The processing system 34, for example, can fit a mathematical function such as a (e.g., seventh order) polynomial 56 to the correlation coefficients as shown in FIG. 7. An example of a polynomial is as follows:

$$R(z)=Az^7+Bz^6+Cz^5+Dz^4+Ez^3+Fz^2+Gz+H \quad \text{(eqn. 5)}$$

where A, B, C, D, E, F, G and H are constants, and z is an arbitrary (e.g., sub-) time step during the first blade time trace. The processing system 34 can subsequently solve the polynomial for the time step (z) value that provides a peak (e.g., maximum) correlation coefficient ($R_{max}$). The peak correlation value determined with the aforesaid polynomial (eqn. 5) is equal to a value of the peak correlation coefficient ($R_{max}$). Utilizing such a mathematical function can increase blade monitoring precision since the arbitrary time step (z) value can be smaller than the time step (t) value set by, for example, an internal processing system clock. The present invention, however, is not limited to any particular types of mathematical functions; e.g., the function may be a Gaussian function, etc.

A person of ordinary skill in the art will recognize that various other methodologies may be implemented by the processing system 34 to determine the peak correlation coefficient. In an alternative embodiment, for example, the processing system 34 may compare the correlation coefficients determined in step 606 to one another in order to determine which of those coefficients has the greatest value. The processing system 34 may subsequently estimate that the peak correlation coefficient is equal to the correlation coefficient with the greatest value.

In step 610, the processing system 34 determines one or more rotor blade properties based on the peak correlation value. The processing system 34 can estimate, for example, that an actual time of arrival (ToA) of a (e.g., leading edge tip) portion of the first blade 22 at the location of the blade position sensor 30 is substantially equal to the time step (z) value that provides the peak correlation coefficient ($R_{max}$). The first blade time of arrival can subsequently be processed with the timing data and the rotor rotational velocity during step 600 to determine first blade deflection, first blade mode of deflection, etc. The timing data, for example, can be processed to determine a predicted time of arrival for the first blade 22. A difference between the actual time of arrival and the predicted time of arrival can subsequently be multiplied by the rotational velocity of the rotor 28 during step 600 to determine the first blade deflection.

Unique rotor blade characteristics such as, for example, manufacturing imperfections, unequal wear, etc. can provide the measurement data for each of the rotor blades with a unique blade signature; e.g., a rotor blade "fingerprint". As illustrated in FIG. 3, for example, features (e.g., peaks, valleys and plateaus) in the first blade measurement data 40 are different from features in the second blade measurement data 42, etc. The processing system 34 can utilize these unique blade signatures to identify one or more of the rotor blades. Such identification can be performed graphically, computationally utilizing the peak correlation value determined in step 608, etc. In one embodiment, for example, the processing system 34 compares the peak correlation value to a threshold. Where the peak correlation value is greater than the threshold, the processing system 34 can affirmatively identify the rotor blade corresponding with the first blade measurement data as the first blade 22.

Various circumstances such as rotor blade jitter and/or once per revolution signal dropout may cause the peak correlation value to be less than the threshold. The term "rotor blade jitter" is used herein to describe a circumstance where the output data provided by the blade position sensor 30 does not include measurement data for one or more of the rotor blades. The term "once per revolution signal dropout" is used herein to describe a circumstance where the timing data does not indicate when the reference point 36 on the rotor 28 passes the rotor position sensor 32 for a particular rotor rotation. Where the peak correlation value is less than the threshold, the processing system 34 may repeat the method of FIG. 6 to determine a second peak correlation value for another portion of the reference data corresponding to the second blade 24. The processing system 34 can subsequently compare the second peak correlation value to the threshold. Where the second peak correlation value is greater than the threshold, the processing system 34 can affirmatively identify the rotor blade corresponding with the first blade measurement data as the second blade 24.

The processing system 34 can determine the presence of rotor blade jitter and/or once per revolution signal dropout based on the identity of the rotor blade corresponding with the first blade measurement data. The presence of rotor blade jitter can be determined where, for example, a peak correlation value of a blade (e.g., the blade 24 or 26) proximate (e.g., adjacent) to the first blade 22 is greater than the threshold. The presence of once per revolution signal dropout can be determined where, for example, a peak correlation value of a blade (e.g., blade 64) distal to first blade 22 is greater than the threshold.

The aforesaid method of FIG. 6 can be performed for a plurality of rotor 28 rotations about the rotational axis 38. In this manner, the processing system 34 can provide averaged first blade measurement data for subsequent processing, determine an average actual time of arrival, determine an average first blade deflection, etc. The processing system 34 can also track changes in the first measurement data during the rotor 28 rotations, for example, to identify and/or determine a magnitude of a rotor blade mode of deflection. Examples of modes of deflection include a bending mode of deflection, a torsional mode of deflection and a chordwise mode of deflection.

Figure 8A:
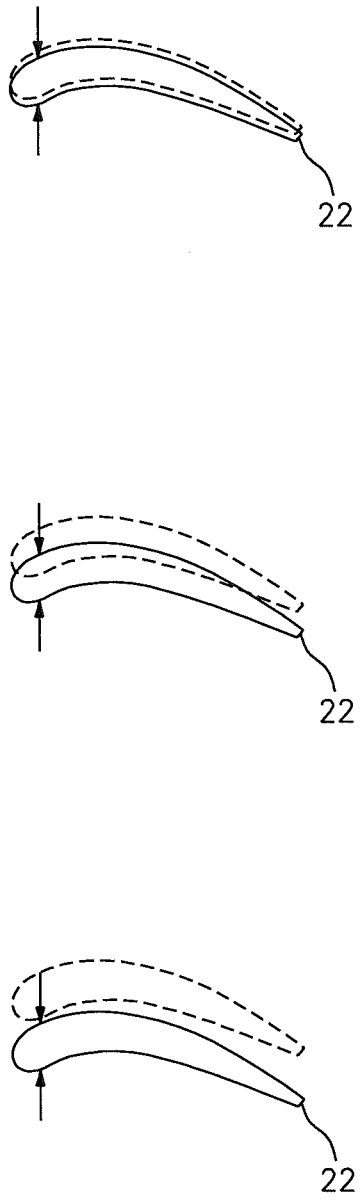
FIG. 8A illustrates a rotor blade at different points during a bending mode of deflection.
Figure 8B:
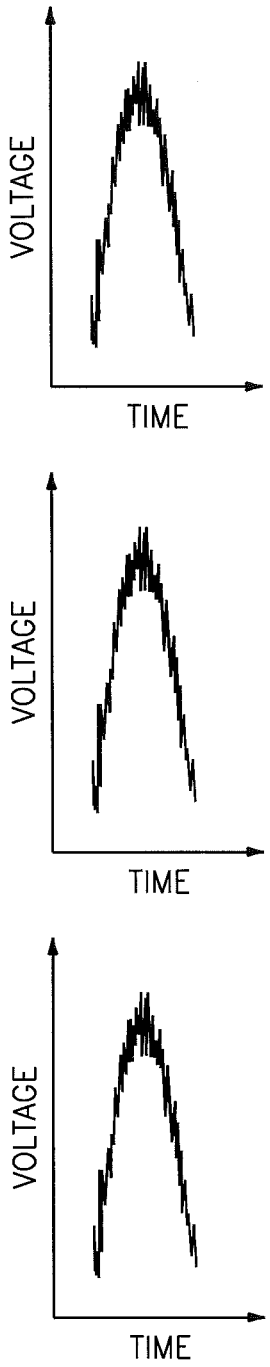
FIG. 8B illustrates blade time traces corresponding to the respective points illustrated in FIG. 8A.

FIG. 8A illustrates the first blade 22 at different points during a bending mode of deflection. FIG. 8B illustrates first blade time traces corresponding to the respective points illustrated in FIG. 8A. During the bending mode of deflection, as illustrated in FIG. 8A, a circumferential thickness of the first blade 22 at a first axial location is substantially equal throughout the deflection. Thus, as illustrated in FIG. 8B, a length of the first blade time trace is also substantially equal throughout the deflection since the time trace begins when the first blade 22 enters the measurement field 48 and ends when the first blade 22 leaves the measurement field 48 (see FIG. 3).

Figure 9A:
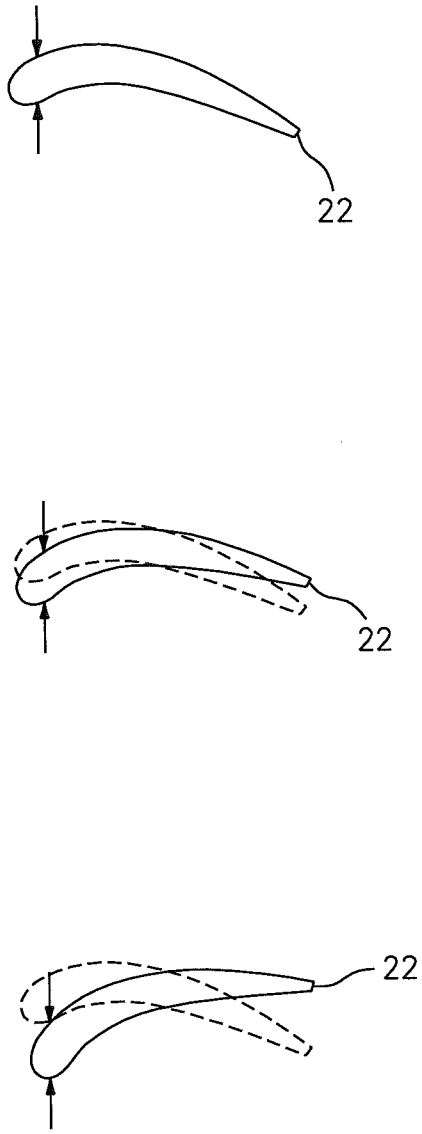
FIG. 9A illustrates a rotor blade at different points during a torsional mode of deflection.
Figure 9B:
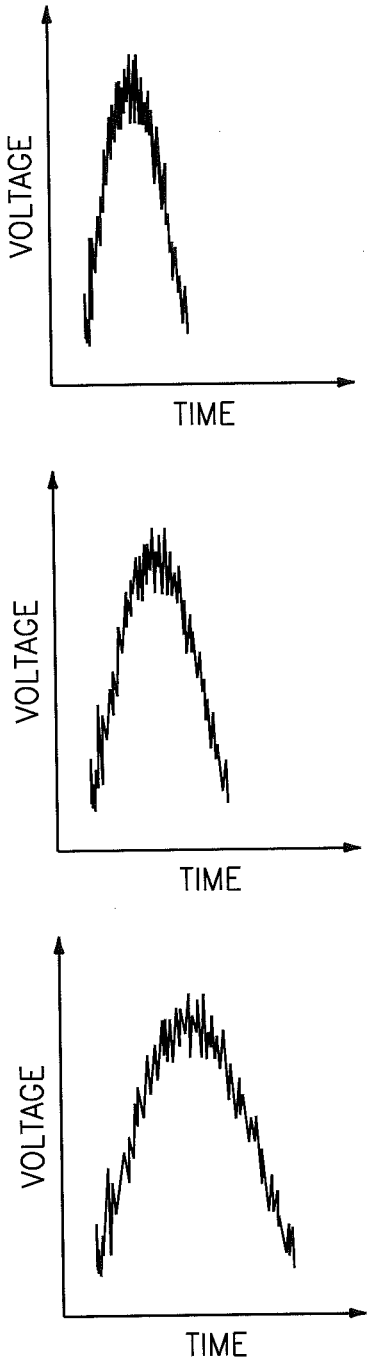
FIG. 9B illustrates blade time traces corresponding to the respective points illustrated in FIG. 9A.

FIG. 9A illustrates the first blade 22 at different points during a torsional mode of deflection. FIG. 9B illustrates first blade time traces corresponding to the respective points illustrated in FIG. 9A. During the torsional mode of deflection, as illustrated in FIG. 9A, the circumferential thickness may change as the first blade 22 pivots about a blade axis during the deflection. The circumferential thickness at the first point therefore may be different (e.g., less) than the circumferential thickness at the second point, etc. Thus, as illustrated in FIG. 9B, the length of the first blade time trace at each respective point may also be different.

Figure 10A:
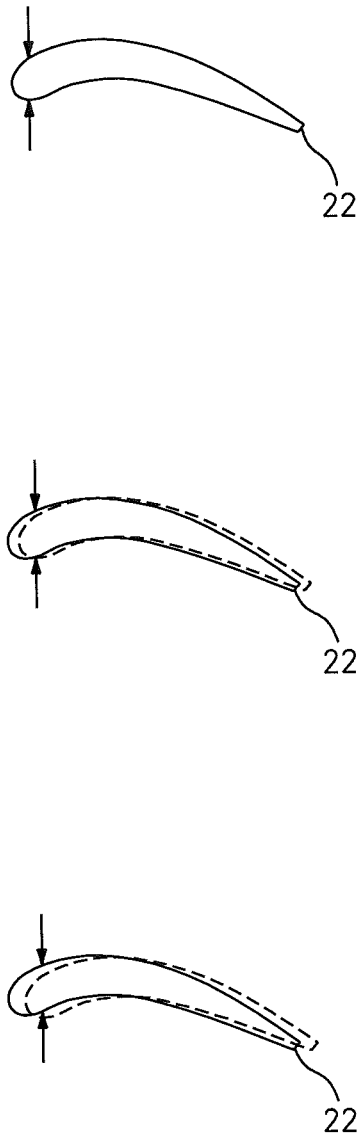
FIG. 10A illustrates a rotor blade at different points during a chordwise mode of deflection.
Figure 10B:
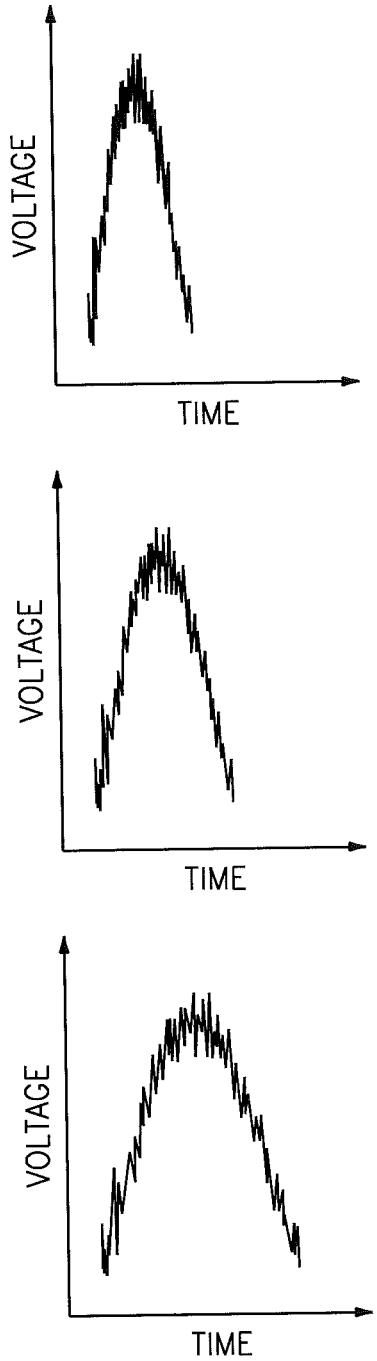
FIG. 10B illustrates blade time traces corresponding to the respective points illustrated in FIG. 10A.

FIG. 10A illustrates the first blade 22 at different points during a chordwise mode of deflection. FIG. 10B illustrates first blade time traces corresponding to the respective points illustrated in FIG. 10A. During the chordwise mode of deflection, as illustrated in FIG. 10A, the circumferential thickness may change as the first blade 22 shifts along its chord. The circumferential thickness at the first point therefore may be different (e.g., less) than the circumferential thickness at the second point, etc. since the circumferential thickness of the first blade 22 varies as a function of location along the chord. Thus, as illustrated in FIG. 10B, the length of the first blade time trace at each respective point may also be different. In contrast to the torsional mode of deflection, however, the chordwise mode of deflection typically occurs over more rotor rotations and, thus, a longer period of time.

Utilizing the aforesaid mode of deflection characteristics, the processing system 34 can process the tracked first measurement data to identify and/or determine the magnitude of the first blade mode of deflection. The processing system 34, for example, can compare (or correlate) the lengths of the first blade time traces and the duration of (e.g., number of rotor rotations during) the deflection to corresponding reference response data in order to identify the first blade mode of deflection. The reference response data can include a plurality of data sets, each of which corresponds to a predicted rotor blade response during a respective mode of deflection. The processing system 34 can subsequently process the first blade measurement data as a function of the identified first blade mode of deflection to determine the magnitude of the first blade mode of deflection as well as other properties. During a chordwise mode of deflection, for example, the processing system 34 can determine that first blade 22 must have moved a first chordwise distance in order to have a certain first blade time trace length. A person of skill in the art will recognize that a similar methodology as described above may also be implemented where the first blade 22 is subject to more than one modes of deflection.

Figure 11:
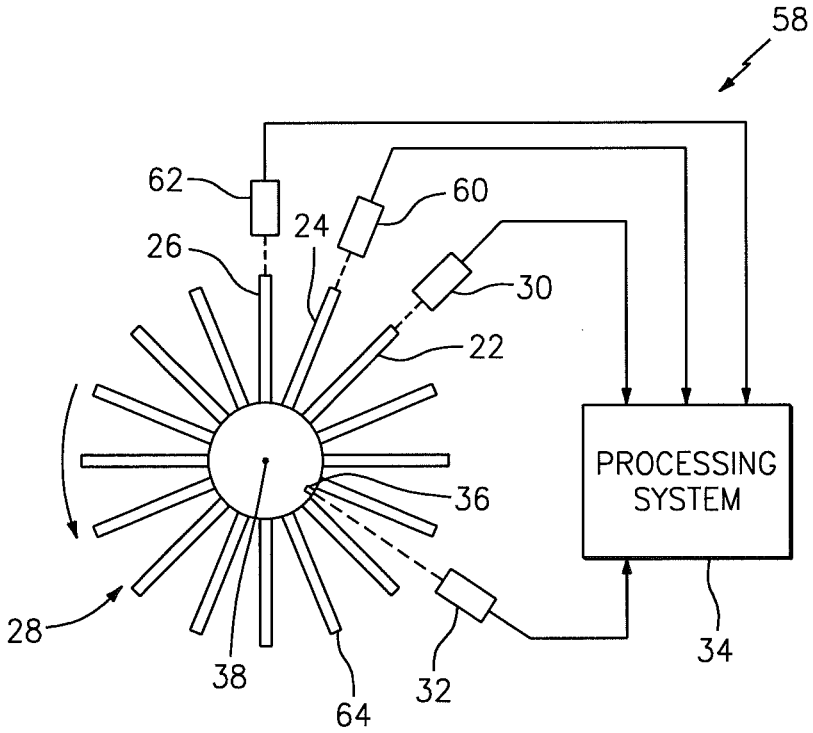
FIG. 11 is a block diagram illustration of another system for monitoring one or more rotor blades of a turbine engine rotor.

FIG. 11 illustrates a block diagram of another system 58 for monitoring one or more rotor blades of a turbine engine rotor. In contrast to the system 20 illustrated in FIG. 1, the system 58 includes one or more additional blade position sensors 60 and 62. These additional blade position sensors 60 and 62 can be utilized to obtain additional sets of measurement data for the first blade 22 during one or more respective rotor 28 rotations. The additional sets of measurement data can be collectively processed, for example, to identify and/or determine the magnitude of a mode of deflection of the first blade 22 as described above. Utilizing the additional sets of measurement data, the processing system 34 can determine the identity and magnitude of the first blade mode of deflection in fewer rotor 28 rotations (i.e., less time) as compared to a method that utilizes a single blade position sensor 30.

The additional sets of measurement data can also be collectively processed to determine a first blade nodal diameter. The term "nodal diameter" is used herein to describe a wave number of a sinusoid that a blade deflection pattern represents. Further description of a nodal diameter is disclosed in U.S. Pat. No. 6,195,982, which is hereby incorporated herein by reference in its entirety. The first blade nodal diameter may be determined by graphically or computationally comparing (or correlating) the measured response of the first blade 22 over one or more rotor 28 rotations to one or more expected responses. A person of ordinary skill in the art will recognize, however, that various other methodologies may be implemented to determine the nodal response.

The additional blade position sensors 60 and 62 can also be utilized to obtain additional sets of measurement data for a plurality of the rotor blades (e.g., the first blade 22, the second blade 24, the third blade 26, etc.) during one or more respective rotor 28 rotations. Typically, each of the rotor blades 22, 24, 26 is subject to a similar modal response at a respective rotor 28 rotational velocity. The additional sets of measurement data for the rotor blades 22, 24 and 26 therefore may be collectively processed, as described above, to determine the identity and magnitude of a rotor blade mode of deflection as well as the nodal diameter.

The additional sets of measurement data for the plurality of the rotor blades 22, 24 and 26 may also be processed to provide a once per revolution signal. The processor, for example, may identify which measurement data corresponds to which rotor blade, and utilize the time of arrival for one of the rotor blades as the once per revolution signal. In this manner, alternate embodiments of the systems 20 and 58 respectively illustrated in FIGS. 1 and 11 may be configured without the rotor position sensor 32. In other embodiments, the once per revolution signal derived from the measurement data may be utilized where there is a dropout in timing data from the rotor position sensor 32.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A method for monitoring one or more rotating turbine engine rotor blades using a processing system and a blade position sensor having a measurement field, the method comprising:

receiving measurement data from the blade position sensor as a first of the rotor blades passes through the measurement field;

correlating the measurement data with reference data as a function of time to provide correlation data; and processing the correlation data to determine a peak correlation value that corresponds to a point in time during the passage of the first of the rotor blades through the measurement field;

determining a time of arrival of the first of the rotor blades at a reference location based on the peak correlation value; and providing a once per revolution signal based on the time of arrival;

determining a property of the rotor blade using the once per revolution signal;

wherein the correlating and the processing are performed by the processing system.

2. The method of claim 1, wherein the correlation data includes a plurality of correlation coefficients, and each of the correlation coefficients corresponds to a different point in time during the passage of the first of the rotor blades through the measurement field.

3. The method of claim 2, wherein the peak correlation value comprises a first of the correlation coefficients having a value that is greater than values of the other correlation coefficients.

4. The method of claim 2, wherein the processing comprises fitting a mathematical function to the correlation coefficients, and processing the mathematical function to determine a peak correlation coefficient, wherein the peak correlation value comprises the peak correlation coefficient.

5. The method of claim 2, wherein the correlating is performed using an equation as follows or an equivalent or a derivation thereof:

$$R_t = \frac{\overline{xy}_t - \overline{x}_t \cdot \overline{y}_t}{\sigma_{x_t} \cdot \sigma_{y_t}},$$

wherein R is the correlation coefficient, $\overline{x}$ is a time averaged matrix of a plurality of reference values included in the reference data, $\overline{y}$ is a time averaged matrix of a plurality of measurement values included in the measurement data, $\sigma_x$ is a standard deviation of x, $\sigma_y$ is a standard deviation of y, and t is a point in time during the passage of the first of the rotor blades through the measurement field.

6. The method of claim 1, further comprising determining the identity of the first of the rotor blades based on the peak correlation value, wherein each of the rotor blades has a different identity.

7. The method of claim 1, further comprising:

comparing the peak correlation value to a threshold; and performing steps as follows where the peak correlation value is less than the threshold:

correlating the measurement data with second reference data as a function of time to provide second correlation data, where the reference data corresponds to the first of the rotor blades, and the second reference data corresponds to an adjacent one of the rotor blades;

processing the second correlation data to determine a second peak correlation value that corresponds to a second point in time during the passage of the first of the rotor blades through the measurement field; and comparing the second peak correlation value to the threshold.

8. The method of claim 7, further comprising determining a time of arrival of the first of the rotor blades at a reference location based on the second peak correlation value where the second peak correlation value is greater than the threshold.

9. The method of claim 7, further comprising determining the identity of the first of the rotor blades based on the second peak correlation value where the second peak correlation value is greater than the threshold, wherein each of the rotor blades has a different identity.

10. The method of claim 9, further comprising determining presence of at least one of a once per revolution signal dropout and rotor blade jitter based on the identity of the first of the rotor blades.

11. The method of claim 1, further comprising:

correlating second measurement data for a second of the rotor blades with second reference data as a function of time to provide second correlation data;

processing the second correlation data to determine a second peak correlation value that corresponds to a second point in time during passage of the second of the rotor blades through one of the measurement field and a second measurement field of a second sensor; and determining a property of one or more of the rotor blades based on the peak correlation value and the second peak correlation value, wherein the property comprises at least one of a modal response magnitude and a nodal diameter.

12. The method of claim 1, further comprising:

performing the correlating and the processing for a plurality of rotations of the first of the rotor blades around an axis to provide the peak correlation value for each of the rotations; and determining a property of the first of the rotor blades based on the peak correlation values.

13. The method of claim 12, wherein the property comprises a time of arrival of the first of the rotor blades at a reference location.

14. The method of claim 12, wherein the property comprises a chordwise deflection of the first of the rotor blades.

15. The method of claim 12, wherein the property comprises at least one of a modal response magnitude and a nodal diameter.

16. The method of claim 1, wherein the processing system is connected to a once per revolution sensor that is discrete from the blade position sensor.

17. A monitoring system for monitoring one or more rotating turbine engine rotor blades, the monitoring system comprising:

a sensor having a measurement field, the sensor configured to be mounted with a turbine engine to provide measurement data as a first of the rotor blades passes through the measurement field; and a processing system configured to correlate the measurement data with reference data as a function of time to provide correlation data; and process the correlation data to determine a peak correlation value that corresponds to a point in time during the passage of the first of the rotor blades through the measurement field, wherein the correlating and the processing are performed by the processing system;

provide second measurement data from a second sensor as the first of the rotor blades passes through a second measurement field of the second sensor;

correlate the second measurement data with the reference data as a function of time to provide second correlation data;

process the second correlation data to determine a second peak correlation value that corresponds to a point in time during the passage of the first of the rotor blades through the second measurement field; and determine a property of the first of the rotor blades based on the peak correlation value and the second peak correlation value.

18. The monitoring system of claim 17, wherein the property comprises a time of arrival of the first of the rotor blades at a reference location.

19. The monitoring system of claim 17, wherein the property comprises a chordwise deflection of the first of the rotor blades.

20. The monitoring system of claim 17, wherein the property comprises a modal response magnitude and/or a nodal diameter.

* * * * *